United States Patent [19]

Naypaver

[11] Patent Number: 5,009,183

[45] Date of Patent: Apr. 23, 1991

[54] TOWLINE AND RELEASE SYSTEM FOR WATER SPORTS ADJUNCT DEVICES

[76] Inventor: Frank R. Naypaver, 351 Florine Ave., Leavittsburg, Ohio 44430

[21] Appl. No.: 450,322

[22] Filed: Dec. 14, 1989

[51] Int. Cl.[5] ..... B63B 21/64

[52] U.S. Cl. ..... 114/253; 441/66

[58] Field of Search ..... 114/253, 254, 244; 441/65-67

[56] References Cited

U.S. PATENT DOCUMENTS

| | | | |
|---|---|---|---|
| 2,721,088 | 10/1955 | Ritter, Jr. | 114/253 X |
| 3,042,944 | 7/1962 | Basey et al. | 114/253 X |
| 3,352,275 | 11/1967 | Wilson | 441/65 X |
| 3,626,428 | 12/1971 | Collaro | 114/253 X |
| 3,803,653 | 4/1974 | Trostad | 114/253 X |
| 4,756,700 | 7/1988 | Coleman | 114/253 X |

*Primary Examiner*—Sherman Basinger

*Attorney, Agent, or Firm*—Low & Low

[57] ABSTRACT

A towline system for water sports adjuncts, as inflatable devices such as air tubes and the like, wherein the air tube may not only be towed along with the usual tow handle, but may be readily released therefrom at the will of the rider without dangerous bending or stooping of the rider, so that other and different activities and exercises may be performed. To this end, the air tube or like device is secured to a lead from the towline by a foot-actuated releasable catch.

11 Claims, 2 Drawing Sheets

TOWLINE AND RELEASE SYSTEM FOR WATER SPORTS ADJUNCT DEVICES

BACKGROUND OF THE INVENTION

Water skiing by towline drawn from a power boat is a popular sports activity, and diverse modes of skiing are practiced for enjoyment, skill, and exhibition, as is well known. While the common ski activity is on water, as lakes, ponds, etc., such enjoyable and challenging activity may also be undertaken over snow-covered fields or long grassy slopes, and the like.

Increasing interest has developed in the use of towable devices drawn behind the towline for the skier's enjoyment other than the many forms of conventional water skis, boards and the like, as for example inflatable devices such as large annular air tubes, similar to but more rugged than so-called inner tubes used for mere flotation play. These inflatable devices are usually attached to the towline in some manner so as to be drawn thereby, and the skier may seek to "ski" with the tube, or oscillate the tube back and forth, or perform other fun or artistic maneuvers. Such devices are commercially available under trade names as "Hi-Planer Water Ski Tube", "Casad Tube", "Water Bug", "Bump-R-Ride", and others.

Quite generally a towline is fixedly attached to the inflatable device with a separate towline and handle for the skier, with both under tension as the device is drawn through the water or over other surfaces. The towline is necessarily attached to the inflatable device as the same is not of streamline or planiform configuration, and offers considerable resistance to being drawn as compared to skis, knee boards, aqua boards or like sleek devices that are intended for ready planing and speed, as the somewhat ungainly and flexible inflatable device is difficult to accelerate to planing speed, but tends to plow in the water, for example, in the absence of skill and tow power.

As such, if the tow rope is held by the skier and not also connected to the inflatable device, the skier or rider is literally pulled over the front of the tube which is quickly left behind.

Once accelerated to sufficient planing speed, however, the relatively large and somewhat flexible platform afforded by the inner tube is easily gripped by the feed or engaged by other portions of the body, and an amazingly smooth ride is attained at high speed in calm water. This contrast with rigid skis or boards which at higher speeds, by virtue of their rigidity, tend to react quickly to water pressures and bounce harshly, and thus do not serve as stable platforms for activities.

The fixed connection, however, limits the versatility of the inflatable device in that the towline connection obviously precludes foot-controlled spinning of the high speed inner tube, or release of the inner tube so that the rider can undertake barefoot skiing or like skills at higher speeds.

BRIEF SUMMARY OF THE INVENTION

The present invention uniquely provides a towline assembly which includes a lead for a usual handle, a lead for an inflatable, as an inner tube, a latch for releasably connecting the lead to the inflatable device, and an operator for quickly and easily releasing the latch to free the air tube from the towline, whereby the skier may control the air tube directly with his feet or take other positions thereon, or even step from the air tube to barefoot ski, as well of course, to stop altogether.

The release means is foot-actuated both for convenience and safety, whereby the operator does not have to remove his grip from the handle or undertake a stooped or unsafe bent over position to manipulate the connection.

As a consequence, the inflatable device now provides not only a versatile and grippable platform, but also may be detached from the towline while in use for further maneuvers during planing, as spinning, as a body support while seated, prone or nearly so, or for ready step off for foot skiing, for example.

DESCRIPTION OF THE DRAWINGS

The invention will be better understood from reference to the accompanying drawings, in which.

DESCRIPTION OF THE PREFERRED EMBODIMENT

Figure 1:
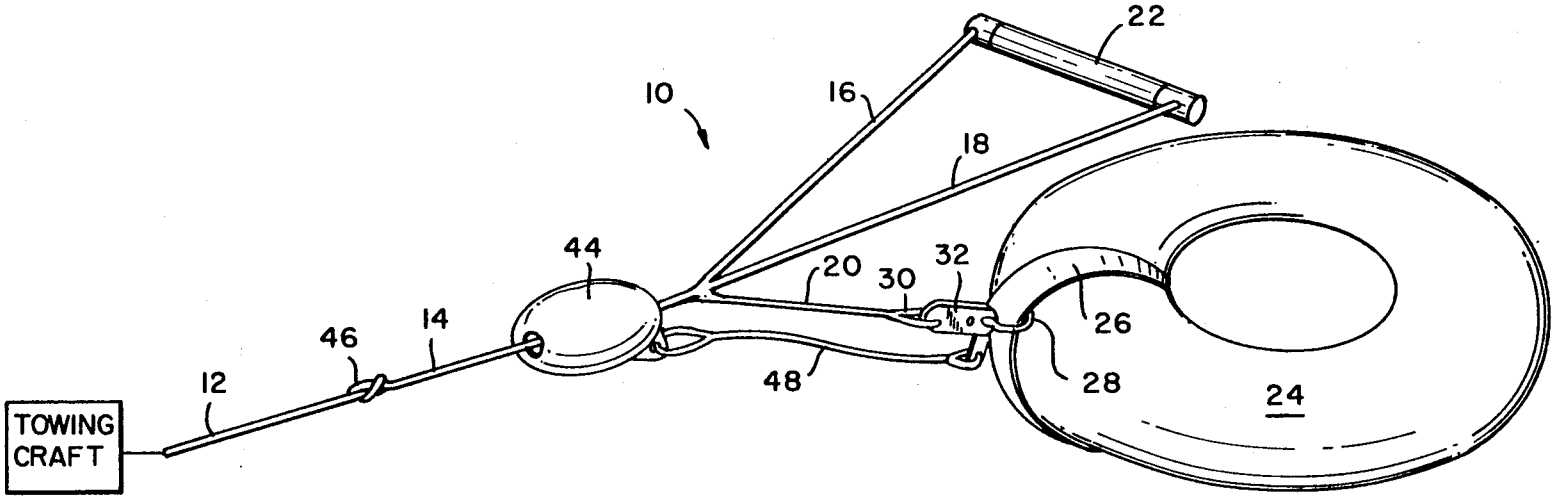
FIG. 1 is a perspective view of the invention as associated with an an inflatable device as an air tube.

Referring to the drawings, there is seen in FIG. 1 at 10 the towline and release device of the invention. The towline includes the usual lead 12 forwardly to the towing craft with conventional attachment thereto, while extending rearwardly is the rearward portion 14 thereof which branches into three leads 16, 18, and 20. The branched leads may be provided in any well known manner as by split braiding, lashing, or preformed division of polymeric line. Leads 16, 18 are conventional and connect in usual manner to a tow handle 22 at either end thereof.

Lead 20 extends for connection to an inflatable device, such as an annular air tube 24 having a tow strap 26 secured therearound with a connecting ring 28 thereon of conventional "D" form. To this end, the lead 20 is formed or provided with an eye 30 to which a latch plate 32 is connected by means of an aperture therein. Latch plate 32 includes a keeper hook 34 pivotally mounted thereto at 36 in known manner and having a terminal tongue 38 cooperating with a slot 40 in the latch plate 32.

Thus, in connecting the latch plate 32 and lead 20 to the air tube 24, slot 40 is placed around the D-ring 28 and the keeper hook 34 manually swung to the closed FIG. 1 position with hook terminal tongue 38 trapping the ring 28 in the slot, whereby the air tube may be towed upon draw on the line 12. Diverse means, as friction mounting of the keeper hook 34 on pivot 36, or a spring-pressed detent 42 cooperating with a recess in the hook 34, or comparable means well known in the art serve to keep the hook in closed position until forcibly pivoted to the open position of FIG. 2, thereby permitting towing of the air tube 24, as in FIG. 3, for example.

As indicated, it is a feature of the invention to have the air tube tow lead 20 readily disconnectable so as to free the air tube for diverse tricks and enjoyable maneuvers by the skier or rider, whether on or off the tube, as seen in FIGS. 4–7, for example.

To that end, the rearward portion 14 of the towline has a bulbous foot-operated actuator member 44 loosely slidable thereon with the towline extending through a bore in member 44. The member 44 may be blow-molded or otherwise formed of plastic, for example, and initially slid onto the towline at the forward portion 12 thereof, and the towline is then knotted as at 46 to enlarge the diameter thereof sufficiently so as to prevent the member 44 from sliding or moving too far forwardly. Member 44 is provided with an ear 48 having an eye therethrough which receives a length of line 48, the other end of which is connected to the distal end of latch hook 34.

Figure 2:
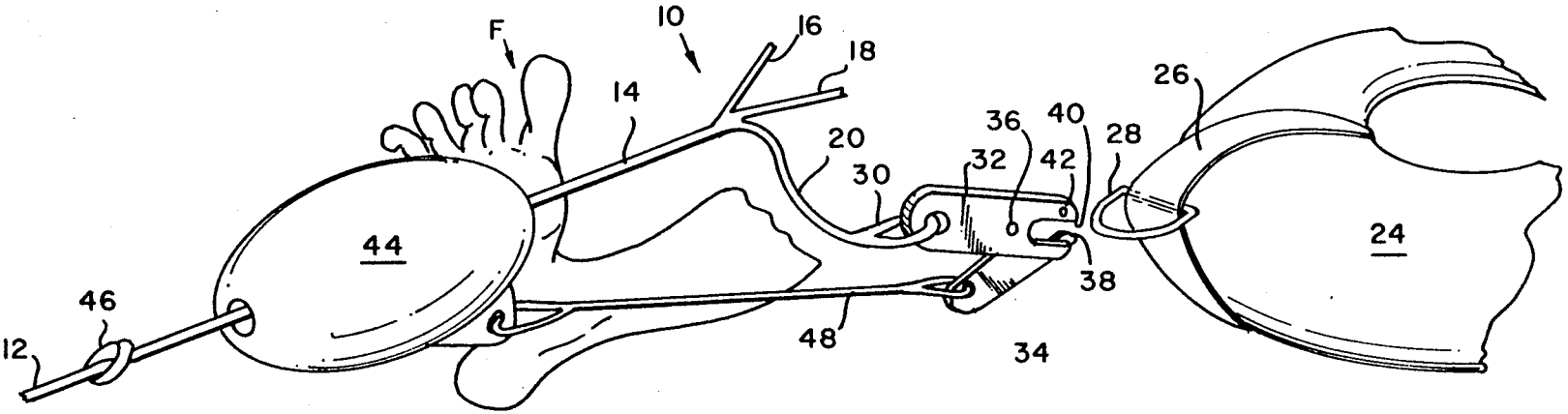
FIG. 2 is a fragmentary perspective view indicating release of the latch on the line to the air tube; and, FIGS. 3–7 inclusive are illustrative of diverse usage of the invention in the performance of tricks and skillful handling.
Figure 5:
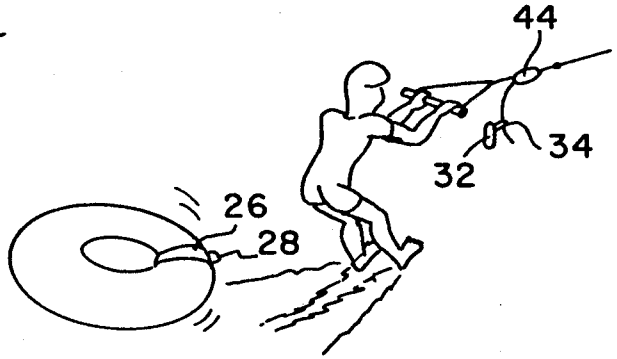
Figure 4:
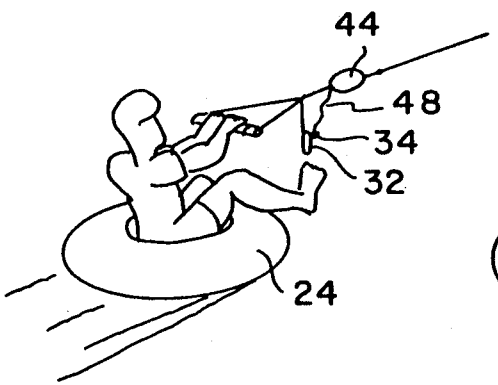
Figure 3:
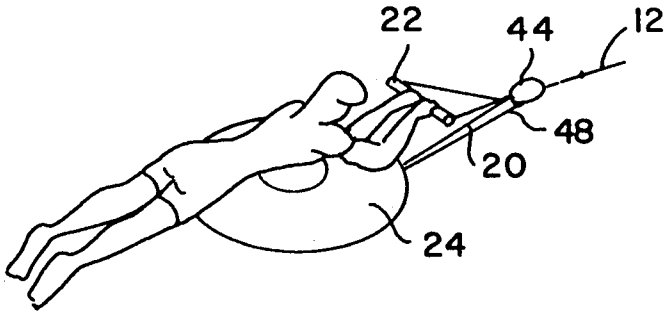
Figure 7:
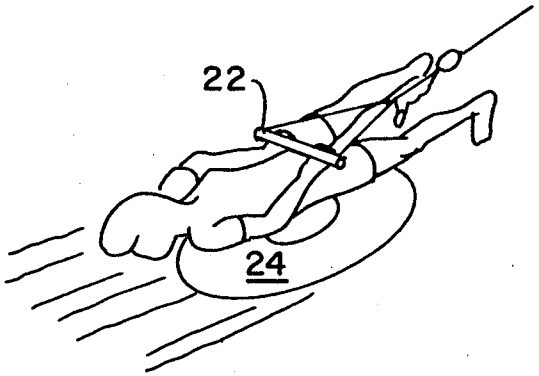
Figure 6:
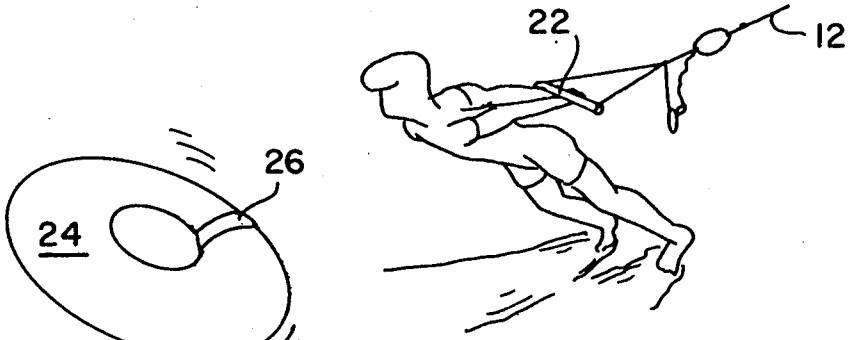

Accordingly, in use, when the air tube 24 is suitably planing or otherwise at a satisfactory speed for the rider or skier, he or she whether standing or sitting on the air tube 24, may extend a foot F forwardly to push bulbous member 44 toward know 46 and thereby sufficiently tension latch connector line 48 to overcome the friction or spring-closed position of latch hook 34 and pivot the same forwardly as seen in FIG. 2, thereby permitting the tube D-ring 28 to be freed from the towline system. It will be seen that this act is performed while the rider may keep both hands on the towline handles 22 and without dangerous bending or stooping at high speed on the planing air tube 24, whereby the rider may leave the air tube to barefoot ski forward or backward as seen in FIGS. 5 and 6, or remain on the freed air tube in sitting or rearward prone positions as seen in FIGS. 4 or 7. Other activities are known and may be practiced and effected with the freed air tube, as causing the air tube to spin or revolve under the feet, or be oscillated as the skier is pulled along by the towline, and so forth.

What I claim is:

1. A towline and release system for water sports adjunct devices as inflated air tubes comprising:

a towline having a first portion thereof connected to a user handle and a second portion thereof adapted for connection to an adjunct device, said second portion including releasable latch means for said adjunct device, and, release means for said latch means, said release means being usable while said towline and adjunct device are under tow, said release means including a manually actuated length of flexible lead extending from said latch means, with said flexible lead having means for slidable association with said towline, and said means is slid with respect to said towline to release said latch, wherein said slidable means is a bulbous member having a bore therethrough for reception of said towline therein whereby when mounted on said towline the bulbous member is carried thereby for engagement to release said latch means.

2. The towline and release system of claim 1 wherein said lead extends between an ear on said bulbous member and a connection on said latch means, whereby movement of said bulbous member along said towline in a direction away from said latch means tensions said lead to pull on said latch means to release the same.

3. The towline and release system of claim 2 wherein said latch means includes two plates mounted for relative pivoting motion to each other, and wherein said lead is connected to one of said plates to pivot the same upon actuation to release said latch means.

4. A towline release system for water sports adjuncts as inflatable air tubes comprising a latch means for a water sports adjunct, said latch means including relatively movable means connecting with the water sports adjunct in a first position and being open to free the connection in a second position, said latch means further having means for connecting to a towline and to a flexible lead, an enlarged manually engageable member having a bore therethrough for slidable reception of a towline therethrough and having means for connection to a flexible lead, and, a flexible lead for connection between said manually engageable member and said latch means, whereby upon mounting said manually engageable member upon a towline, connecting said latch means to the towline and the water sports adjunct, sliding movement of said manually engageable member along said towline away from said latch means and said water sports adjunct tensions said flexible lead and releases said latch means to said second position to free said water sports adjunct.

5. The towline release system of claim 4 wherein said manually engageable member is buoyant.

6. In a towline system for water sports adjunct devices as air tubes said system including a towline for connection at one end to a towing means and at the other end having handle means for a user and also a line for connection to said adjunct device at its other end including latch means for the adjunct device, the improvement therein to permit ready release of the adjunct device by the user as desired, comprising, said latch means having means for releasing the same from connection to the adjunct device upon pulling pressure being applied to a portion of said latch means, a member mountable upon said towline for slidable movement thereon in response to manual pressure, and, a flexible lead interconnecting said member and said latch releasing means, whereby upon manual movement of said member along said towline to tension said lead to said latch means, said releasing means is operated to free the adjunct device from the towline.

7. The improved towline system of claim 6 further including an enlargement on said towline forwardly of said slidable member to limit the possible forward sliding movement thereof.

8. The improved towline system of claim 7 wherein said enlargement is a knot in said towline.

9. A method of towline and release control for water sports adjuncts, comprising the steps of:

providing tension-releasable latch means including a length of flexible lead, attaching the latch means to water sports adjunct so as to be releasable therefrom, providing a manually engageable member, attaching the flexible lead at one end to the manually engageable member, and, mounting the manually engageable member for sliding movement on a towline, whereby sliding movement of said manaually engageable member on said towline by an operator will tension the flexible lead and release the latch means to free the water sports adjunct.

10. The method of claim 9 including the further step of providing obstruction means on the towline to limit sliding movement of the manually engageable member thereon.

11. The method of claim 9 wherein the provided manually engageable member is of floatable bulbous configuration for ready sliding manipulation by the operator.

* * * * *